US012630936B2

(12) United States Patent
Chenitz et al.

(10) Patent No.: US 12,630,936 B2
(45) Date of Patent: May 19, 2026

(54) MULTILAYERED ANODE IN LIQUID BASED ELECTROLYSIS

(71) Applicant: NATIONAL RESEARCH COUNCIL OF CANADA, Ottawa (CA)

(72) Inventors: Régis Chenitz, Boucherville (CA); Asmae Mokrini, Montréal (CA); Jean-Yves Huot, Austin (CA)

(73) Assignee: National Research Council of Canada, Ottawa (CA)

( * ) Notice: Subject to any disclaimer, the term of this patent is extended or adjusted under 35 U.S.C. 154(b) by 467 days.

(21) Appl. No.: 17/924,259

(22) PCT Filed: May 10, 2021

(86) PCT No.: PCT/CA2021/050646
§ 371 (c)(1),
(2) Date: Nov. 9, 2022

(87) PCT Pub. No.: WO2021/226708
PCT Pub. Date: Nov. 18, 2021

(65) Prior Publication Data

US 2023/0220568 A1 Jul. 13, 2023

Related U.S. Application Data

(60) Provisional application No. 63/024,109, filed on May 13, 2020.

(51) Int. Cl.
*C25B 11/00* (2021.01)
*C25B 9/17* (2021.01)
(Continued)

(52) U.S. Cl.
CPC ..... *C25B 11/032* (2021.01); *C25B 9/17* (2021.01); *C25B 11/053* (2021.01);
(Continued)

(58) Field of Classification Search
CPC ... C25B 11/032; C25B 11/081; C25B 11/056; C25B 9/17; C25B 11/053; C25B 1/16
See application file for complete search history.

(56) References Cited

U.S. PATENT DOCUMENTS 2,913,511 A 11/1959 Grubb, Jr.
4,175,165 A 11/1979 Adlhart
(Continued)

FOREIGN PATENT DOCUMENTS

WO 2011/066293 A1 6/2011
WO 2013/159194 A1 10/2013
(Continued)

OTHER PUBLICATIONS

Bayer, Thomas et al., Spray Deposition of Nafion Membranes: Electrode-Support Fuel Cells, Journal of Power Sources, (2016), vol. 327, pp. 319-326.
(Continued)

*Primary Examiner* — Zulmariam Mendez
(74) *Attorney, Agent, or Firm* — Aird & McBurney LP

(57) ABSTRACT

A coated electrode assembly (CEA) comprising: i) a gas diffusion layer (GDE); and ii) a coating. The GDE comprises a gas diffusion layer (GDL) and a catalyst layer. The catalyst layer is disposed between the coating and the GDL. The catalyst layer comprises a hydrophobic polymer and/or an ionomeric polymer and the coating comprises a hydrophobic polymer and/or an ionomeric polymer. A method for making a CEA is provided. The CEA may have improved performance and stability compared to a membrane electrode assembly (MEA).

20 Claims, 10 Drawing Sheets

(51) Int. Cl.

| | |
|---|---|
| ***C25B 11/032*** | (2021.01) |
| ***C25B 11/053*** | (2021.01) |
| ***C25B 11/056*** | (2021.01) |
| ***C25B 11/065*** | (2021.01) |
| ***C25B 11/081*** | (2021.01) |
| *C25B 1/16* | (2006.01) |

(52) U.S. Cl.
CPC ..... *C25B 11/056* (2021.01); *C25B 11/065* (2021.01); *C25B 11/081* (2021.01); *C25B 1/16* (2013.01)

(56) References Cited

U.S. PATENT DOCUMENTS

| | | | |
|---|---|---|---|
| 4,319,969 | A | 3/1982 | Oda et al. |
| 4,444,639 | A | 4/1984 | Schurig et al. |
| 4,561,945 | A | 12/1985 | Coker et al. |
| 5,176,966 | A | 1/1993 | Epp et al. |
| 5,595,641 | A | 1/1997 | Traini et al. |
| 5,746,896 | A | 5/1998 | Shimamune et al. |
| 7,235,320 | B2 | 6/2007 | Calundann et al. |
| 7,820,314 | B2 | 10/2010 | Calundann et al. |
| 7,833,645 | B2 | 11/2010 | Fuglevand et al. |
| 7,993,499 | B2 | 8/2011 | Zuber et al. |
| 9,150,970 | B2 | 10/2015 | Bulan et al. |
| 9,163,318 | B2 | 10/2015 | Kintrup et al. |
| 9,273,404 | B2 | 3/2016 | Bulan et al. |
| 9,543,607 | B2 | 1/2017 | Mokrini |
| 2005/0014056 | A1 | 1/2005 | Zuber et al. |
| 2006/0199062 | A1 | 9/2006 | Yanagita et al. |
| 2008/0029404 | A1 | 2/2008 | Weber et al. |
| 2010/0140103 | A1 | 6/2010 | Gilliam et al. |
| 2014/0315121 | A1 | 10/2014 | Ghielmi et al. |
| 2016/0032471 | A1 | 2/2016 | Magnan et al. |
| 2018/0244531 | A1 | 8/2018 | Magnan et al. |

FOREIGN PATENT DOCUMENTS

| | | | |
|---|---|---|---|
| WO | 2015/123762 | A1 | 8/2015 |
| WO | 2017/118712 | A1 | 7/2017 |
| WO | 2019020239 | A1 | 1/2019 |

OTHER PUBLICATIONS

Breitwieser Matthias, Direct Membrane Deposition as Novel Fabrication Technique for High Performance Fuel Cells, ( 2017).

Breitwieser, Matthias et al., A Fully Spray-Coated Fuel Cell Membrane Electrode Assembly Using Aquivion Ionomer with a Graphene Oxide/Cerium Oxide Interlayer, Journal of Power Sources, (2017) vol. 351, pp. 145-150.

Holzapfel, Peter et al., Directly coated membrane electrode assemblies for proton exchange membrane water electrolysis, Electrochemistry Communications, (2020), vol. 110, 5 pages.

Klingele, Matthias et al, Direct Deposition of Proton Exchange Membranes Enabling High Performance Hydrogen Fuel Cells, Journal of Materials Chemistry A, ( 2015), vol. 3, pp. 11239-11245.

Kusoglu Ahmet et al., New Insights into Perfluorinated Sulfonic-Acid Ionomers, Chem. Rev., (2017), vol. 117, pp. 987-1104.

Lim, Chan et al, Effects of Hydrophobic Polymer Content in GDL on Power Performance of a PEM Fuel Cell, Electrochem. Acta, (2004), vol. 49, pp. 4149-4156.

Truong, Van Men et al, Effect of Gas Diffusion Layer Thickness on the Performance of Anion Exchange Membrane Fuel Cells, Processes, (2021) vol. 9, 10 pages; Academic Editor: Alessandro D'Adamo.

International Preliminary Report on Patentability dated Nov. 24, 2022 from counterpart International Patent Application No. PCT/CA2021/050646.

Extended European Search Report dated dated Sep. 23, 2024, including the Supplementary European Search Report, issued for corresponding EP Application No. 21803773.7.

Solid symbol= cell voltage

Open symbol= cell voltage – $iR_{drop}$ with R measured by impedance at 0 Amps

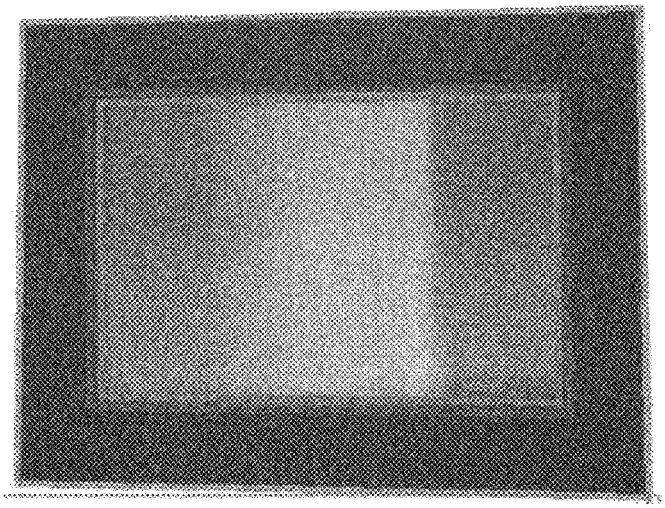
Figure 9
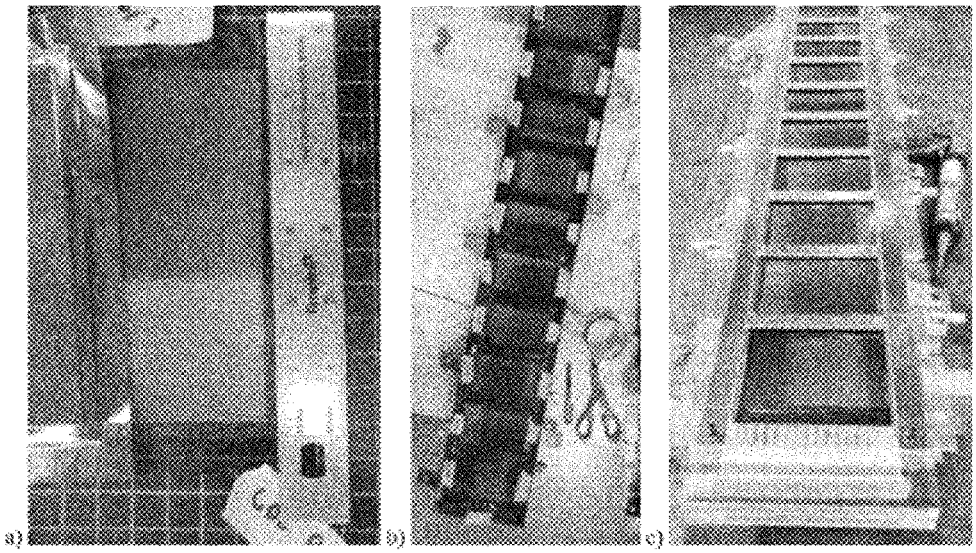
Figures 10a-c

MULTILAYERED ANODE IN LIQUID BASED ELECTROLYSIS

RELATED APPLICATIONS

The present application is a U.S. National Stage filing under 35 U.S.C. § 371 of International Application No. PCT/CA2021/050646 filed May 10, 2021, which claims priority to U.S. Provisional Application No. 63/024,109 filed May 13, 2020, the contents of which are incorporated herein by reference in their entireties.

FIELD

The present disclosure relates to electrolysis and, in particular, the present disclosure relates to multilayered anodes for depolarized electrolysis and the method of making the same.

BACKGROUND

Direct electrolysis of water-based acidic electrolyte requires expensive dimensionally stable anodes (DSA). In order to decrease cell voltage, depolarization of a cell can occur using hydrogen depolarized anodes (HDA). Certain HDAs can have a gas diffusion electrode and an ion exchange membrane that enables hydrogen gas consumption and can manage the exchange of protons ($H^+$) with a liquid electrolyte.

Ion exchange membranes have been useful in electrochemical systems such as electrolyzers (U.S. Pat. Nos. 4,444,639, 7,993,499 or US2005/0014056) where hydrogen and oxygen gases are produced from water and electricity or, in reverse, when hydrogen and oxygen are consumed in fuel cells to produce electricity (U.S. Pat. Nos. 4,175,165, 5,176,966, 2,913,511, or 7,833,645). The ion exchange membrane acts not only as the electrolyte but also as a physical barrier separating fluids such as gases and liquids. US2010/0140103 depicts a gas diffusion anode, which incorporates a cation exchange membrane to be able to exchange protons (H+) produced at the anode, by the consumption of hydrogen gas, with the liquid electrolyte. Other examples of anodes are described in WO2011/066293, WO2017/118712, and US2018/0244531. The cation exchange membranes are expensive materials and can represent up to a third of the cost of such anodes.

Although the anodes described above are useful, there is still a need for alternative HDAs.

The background herein is included solely to explain the context of the disclosure. This is not to be taken as an admission that any of the material referred to was published, known, or part of the common general knowledge as of the priority date.

SUMMARY

In an aspect, there is provided a coated electrode assembly (CEA) comprising: i) a gas diffusion electrode (GDE); and ii) a coating, wherein the GDE comprises a gas diffusion layer (GDL) and a catalyst layer, the catalyst layer being disposed between the coating and the GDL, and wherein the catalyst layer comprises a hydrophobic polymer and/or an ionomeric polymer and the coating comprises a hydrophobic polymer and/or an ionomeric polymer.

In another aspect, there is provided a coated electrode assembly (CEA) comprising: i) a gas diffusion electrode (GDE); and ii) a coating, wherein the GDE comprises a gas diffusion layer (GDL) and a catalyst layer, the catalyst layer being disposed between the coating and the GDL, wherein the catalyst layer comprises a hydrophobic polymer and/or an ionomeric polymer and the coating comprises a hydrophobic polymer and/or an ionomeric polymer, and wherein at least one of the catalyst layer and the coating comprises the ionomeric polymer.

The aspects described herein may further comprise one or more of the following aspects for the CEA. In another aspect, wherein the catalyst layer is adjacent to the GDL and the coating is adjacent to the catalyst layer. In another aspect, wherein the catalyst layer is in contact with the GDL and the coating is in contact with the catalyst layer. In another aspect, wherein the catalyst layer comprises the hydrophobic polymer and the coating comprises the ionomeric polymer. In another aspect, wherein the catalyst layer comprises the ionomeric polymer and the coating comprises the hydrophobic polymer. In another aspect, wherein the catalyst layer comprises the ionomeric polymer and the coating comprises the ionomeric polymer. In another aspect, wherein the catalyst layer comprises the hydrophobic polymer and the ionomeric polymer, and the coating comprises the ionomeric polymer. In another aspect, wherein the catalyst layer comprises the hydrophobic polymer and the ionomeric polymer, and the coating comprises the hydrophobic polymer. In another aspect, wherein the catalyst layer comprises the hydrophobic polymer and the coating comprises the ionomeric polymer and the hydrophobic polymer. In another aspect, wherein the catalyst layer comprises the ionomeric polymer and the coating comprises the ionomeric polymer and the hydrophobic polymer. In another aspect, wherein the coating is deposited on the catalyst layer. In another aspect, wherein the coating is non-detachable. In another aspect, wherein the coating and/or the catalyst layer is porous and/or non-continuous. In another aspect, wherein the coating and/or the catalyst layer is mesoporous. In another aspect, wherein the coating and/or the catalyst layer has a pore size range of from about 2 nm to about 50 nm. In another aspect, wherein the coating and/or the catalyst layer is macroporous. In another aspect, wherein the coating and/or the catalyst layer has a pore size range of from about 50 nm to about 200 nm. In another aspect, wherein the coating has a thickness of about 100 nm to about 2 μm. In another aspect, wherein the coating has a thickness of about 100 nm to about 1 μm. In another aspect, wherein the coating minimizes flooding of the catalyst layer. In another aspect, wherein the ionomeric polymer comprises a perfluorinated sulfonic acid ionomer. In another aspect, wherein the ionomeric polymer is selected from a perfluorinated sulfonic acid (PFSA) such as Nafion®, Aquivion®, Flemion® and 3M®, polystyrene sulfonate (PSS), or combinations thereof. In another aspect, wherein the hydrophobic polymer comprises hydrophobic fluorine resins. In another aspect, wherein the hydrophobic polymer is selected from polychlorotrifluoroethylene resin (PCTFE), polytetrafluoroethylene resin (PTFE), polyvinylidene fluoride resin (PVDF), tetrafluoroethylene-hexa fluoro propylene copolymer (FEP), tetrafluoroethylene-perfluoroalkylvinyl ether copolymer (PFA), and tetrafluoroethylene-ethylene copolymer (ETFE). In another aspect, wherein the hydrophobic polymer comprises polytetrafluoroethylene (PTFE). In another aspect, wherein the CEA excludes a membrane. In another aspect, wherein the CEA is resistant to flooding. In another aspect, wherein the catalyst layer is a metal catalyst-based layer, the metal for electro-oxidizing $H_2$ to $H^+$. In another aspect, wherein the CEA has improved or similar performance and stability compared to a membrane electrode assembly (MEA), each assembly having the same GDE. In another aspect, wherein the CEA has a lower resistance compared to a membrane electrode assembly (MEA), each assembly having the same gas diffusion electrode (GDE). In another aspect, wherein the CEA reached the MEA performance with a current density up to about 4 kA $m^{-2}$ under about 10 $g_{Li}$/L. In another aspect, wherein the MEA has a hot-pressed membrane. In another aspect, wherein the CEA is operable at an electrical current density up to about 6 kA/$m^2$, up to about 5 kA/$m^2$, up to about 4 kA/$m^2$, from about 1 kA/$m^2$ to about 6 kA/$m^2$, from about 1 kA/$m^2$ to about 5 kA/$m^2$, from about 1 kA/$m^2$ to about 4 kA/$m^2$, or about 3 kA/$m^2$ to about 4 kA/$m^2$. In another aspect, wherein the CEA is operable at an electrical current density up to about 4 kA/$m^2$ under about 10 $g_{Li}$/L and at a temperature of about 60° C.

In another aspect, there is provided a hydrogen depolarized gas diffusion anode (HDA) comprises the CEA as defined in one or more of the aspects described herein.

In another aspect, there is provided an electrolytic cell comprising the CEA as defined in one or more of the aspects described herein or the HDA as defined in one or more of the aspects described herein.

The aspects described herein may further comprise one or more of the following aspects for the electrolytic cell. In another aspect, wherein the cell is operable at an electrical current density up to about 6 kA/$m^2$, up to about 5 kA/$m^2$, up to about 4 kA/$m^2$, from about 1 kA/$m^2$ to about 6 kA/$m^2$, from about 1 kA/$m^2$ to about 5 kA/$m^2$, from about 1 kA/$m^2$ to about 4 kA/$m^2$, or about 3 kA/$m^2$ to about 4 kA/$m^2$. In another aspect, wherein the cell is operable at a temperature from about 20° C. to about 80° C., from about 30° C. to about 80° C., from about 40° C. to about 80° C., from about 50° C. to about 70° C., from about 50° C. to about 65° C., or about 60° C.

In another aspect, there is provided an electrochemical acidification electrolyzer comprising the CEA as defined in one or more of the aspects described herein or the HDA as defined in one or more of the aspects described herein.

The aspects described herein may further comprise one or more of the following aspects for the electrolyzer. In another aspect, wherein the cell is operable at an electrical current density up to about 6 kA/$m^2$, up to about 5 kA/$m^2$, up to about 4 kA/$m^2$, from about 1 kA/$m^2$ to about 6 kA/$m^2$, from about 1 kA/$m^2$ to about 5 kA/$m^2$, from about 1 kA/$m^2$ to about 4 kA/$m^2$, or about 3 kA/$m^2$ to about 4 kA/$m^2$. In another aspect, wherein the cell is operable at a temperature from about 20° C. to about 80° C., from about 30° C. to about 80° C., from about 40° C. to about 80° C., from about 50° C. to about 70° C., from about 50° C. to about 65° C., or about 60° C.

In another aspect, there is provided use of the CEA of one or more of the aspects described herein or the HDA of one or more of the aspects described herein for electrochemical acidification. In another aspect, there is provided use of the CEA of one or more of the aspects described herein or the HDA of one or more of the aspects described herein in a fuel cell.

In another aspect, there is provided an electrolytic system comprising: an anolyte region positioned in an electrochemical cell having an anode, wherein the anolyte region receives an anolyte feed and the anode comprises the CEA as defined in one or more of the aspects described herein or the HDA as defined in one or more of the aspects described herein; a catholyte region positioned in the electrochemical cell having a cathode, wherein the catholyte region receives a catholyte feed; and an electrical current supplier for applying an electrical current between the anode and the cathode.

The aspects described herein may further comprise one or more of the following aspects for the system. In another aspect, wherein the cathode comprises or consists of nickel, palladium, rhodium, indium, cobalt, stainless steel or carbon. In another aspect, wherein the system is an electrolyser.

In another aspect, there is provided a method for making the CEA of one or more of the aspects described herein or the HDA of one or more of the aspects described herein, the method comprising: forming the coating on the catalyst layer of the GDE.

The aspects described herein may further comprise one or more of the following aspects for the method. In another aspect, wherein forming comprises depositing a coating composition on the catalyst layer, the coating composition comprising the hydrophobic polymer and/or the ionomeric polymer. In another aspect, wherein the depositing comprises spraying, gap coating, slot die coating, roll coating, or gravure coating the coating composition. In another aspect, wherein the coating composition is a dispersion. In another aspect, wherein spraying comprises spraying the coating composition with a pressurized dispensing valve. In another aspect, wherein the coating has a thickness of about 100 nm to about 2 μm. In another aspect, wherein the coating has a thickness of about 100 nm to about 1 μm.

In another aspect, there is provided a CEA as defined in one or more of the aspects described herein made using the method of one or more of the aspects described herein.

The novel features will become apparent to those of skill in the art upon examination of the following detailed description. It should be understood, however, that the detailed description and the specific examples presented, while indicating certain aspects of the present disclosure, are provided for illustration purposes only because various changes and modifications within the spirit and scope will become apparent to those of skill in the art from the detailed description and claims that follow.

BRIEF DESCRIPTION OF THE DRAWINGS

The present disclosure will be further understood from the following description with reference to the Figures, in which:

FIG. 9 shows a GDE of Example 1.

FIGS. 10*a* to 10*c* show a) an embodiment of a single Gas Diffusion Electrode (GDE) panel with Kapton™-taped perimeter (hydrophobic coat showing); b) "window frame" assembly of embodiments of GDEs aligned before installation; c) center compartment on top of GDE assembly.

DETAILED DESCRIPTION

Definitions

Figure 1:
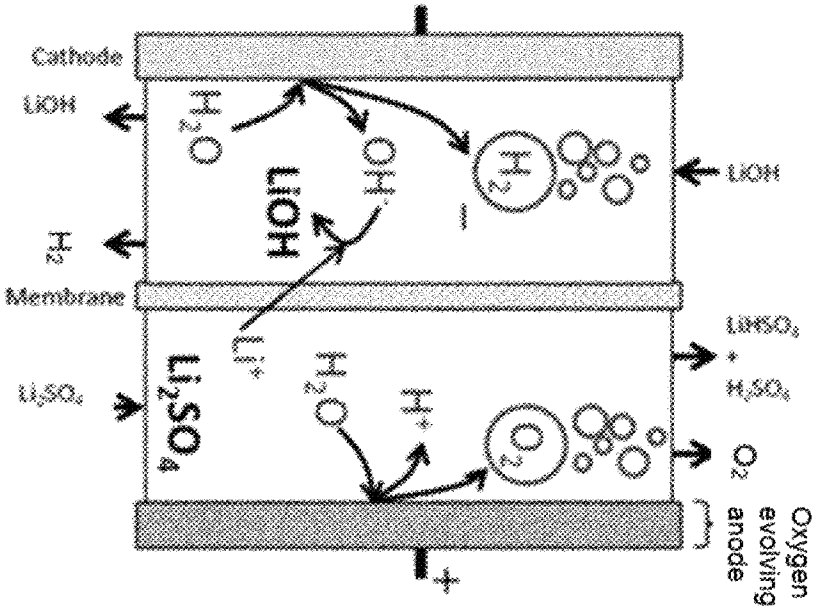
FIG. 1 shows an oxygen evolving anode for lithium hydroxide (LiOH) production via membrane electrolysis of lithium sulfate ($Li_2SO_4$).

Unless otherwise explained, all technical and scientific terms used herein have the same meaning as commonly understood by one of ordinary skill in the art to which this disclosure belongs. Although any methods and materials similar or equivalent to those described herein can be used in the practice for testing of the present invention, the typical materials and methods are described herein. In describing and claiming the present invention, the following terminology will be used.

As used herein, the term "coat" or "coating" as used herein is understood to be distinct from a membrane. A coat or coating may not be considered a separate layer in comparison to a membrane. For example, a membrane is formed as a separate layer and the layer itself is applied to a layer/electrode. The membrane is a detachable layer (e.g. sheet), which can be removed from the layer/electrode and manipulated separately; whereas, a coating is a non-detachable layer.

As used herein, the term "dispersion" as used herein is understood to be a two phase system wherein one phase comprises particles (e.g. a colloidal size range) which is distributed throughout a bulk substance. For example, the particles being the dispersed or internal phase and the bulk substance being the continuous or external phase.

The term "flooding" as used herein is understood as hindering gas transport by blocking the pores in a layer (e.g. a porous catalyst layer or Gas Diffusion Layer (GDL)) whereby water accumulates in the pores of the layer. When such a phenomenon occurs, since it is difficult for oxygen and/or hydrogen to reach the pores, the gas diffusion resistance of a cell obtained may increase. In this case, an overvoltage may occur in an electrode and performance of the cell may deteriorate. Flooding is typically evaluated by a continuous or sharp deviation of cell performance, typically +1.5V of initial cell voltage. By minimizing flooding, reducing flooding, resistant to flooding or preventing flooding in a cell, the cell may maintain its performance. For example, the performance of the cell is substantially maintained in comparison to the performance of the cell when initially used.

The term "ionomer" or "ionomeric polymer" as used herein is understood to be a polymer having ionizable groups, ionic groups, or both, which are covalently bonded to the polymer. Any suitable mol % of the polymer may comprise ionizable groups, ionic groups, or both. For example, and without being limited thereto, at least about 5 mol %, at least about 10 mol %, at least about 15 mol %, at least about 20 mol %, at least about 25 mol %, at least about 40 mol %, at most about 5 mol %, at most about 10 mol %, at most about 15 mol %, at most about 20 mol %, at most about 25 mol %, at most about 40 mol % of the polymer comprises ionizable groups, ionic groups, or both. The groups may be any suitable ionizable groups (e.g. sulfonyl halides such as sulfonyl fluoride, sulfonyl chloride, sulfonyl bromides, and phosphonyl halides) and/or ionic groups (e.g. carboxylic acid, sulfonic acid, phosphonic acid, sulfonyl imide, sulfonate, fluoro, and amino groups) that may allow the passage of hydrogen ions while minimizing the passage of hydroxyl ions and other anions. The classification of a polymer as an ionomer may depend on the level of substitution of ionic groups as well as how the ionic groups are incorporated into the polymer structure. Ionomers may have unique physical properties including ionic conductivity and viscosity such as an increase in ionomer solution viscosity with increasing temperatures. Ionomers may also have unique morphological properties as the non-polar polymer backbone is energetically incompatible with the polar ionic groups. Examples include perfluorinated sulfonic-acid ionomers such as:

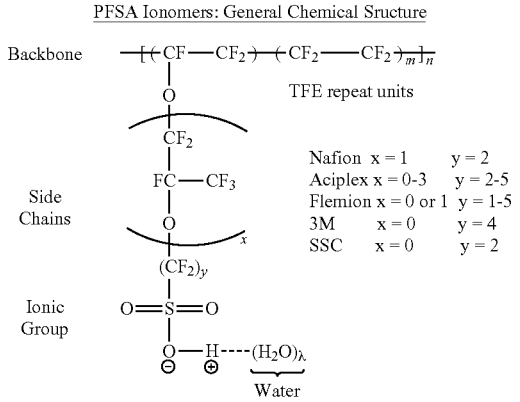

(A. Kusoglu and A. Z. Weber, Chem. Rev. 2017, 117, 987-1104). Common examples of ionomers include a perfluorinated sulfonic acid (PFSA) such as Nafion®, Aquivion®, Flemion® and 3M®, polystyrene sulfonate (PSS), and other partially fluorinated and hydrocarbon non-fluorinated ionomers.

When introducing elements disclosed herein, the articles "a", "an", "the", and "said" are intended to mean that there may be one or more of the elements.

The term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. It will be understood that any embodiments described as "comprising" certain components may also "consist of" or "consist essentially of," these components, wherein "consisting of" has a closed-ended or restrictive meaning and "consisting essentially of" means including the components specified but excluding other components except for materials present as impurities, unavoidable materials present as a result of processes used to provide the components, and components added for a purpose other than achieving the technical effects described herein.

It will be understood that any component defined herein as being included may be explicitly excluded from the claimed invention by way of proviso or negative limitation, such as any specific compounds or method steps, whether implicitly or explicitly defined herein.

In addition, all ranges given herein include the end of the ranges and also any intermediate range points, whether explicitly stated or not.

Finally, terms of degree such as "substantially", "about" and "approximately" as used herein mean a reasonable amount of deviation of the modified term such that the end result is not significantly changed. These terms of degree should be construed as including a deviation of at least ±5% of the modified term if this deviation would not negate the meaning of the word it modifies.

The abbreviation, "e.g." is derived from the Latin exempli gratia, and is used herein to indicate a non-limiting example. Thus, the abbreviation "e.g." is synonymous with the term "for example." The word "or" is intended to include "and" unless the context clearly indicates otherwise. The word "and/or" is intended to include both or either.

The phrase "at least one of" is understood to be one or more. The phrase "at least one of . . . and . . . " is understood to mean at least one of the elements listed or a combination thereof, if not explicitly listed. For example, "at least one of A, B, and C" is understood to mean A alone or B alone or C alone or a combination of A and B or a combination of A and C or a combination of B and C or a combination of A, B, and C.

Coated Electrode Assembly (CEA)

In an embodiment, a layer-structured anode is provided that may be used at the negative electrode of an electrolysis cell.

Figure 2:
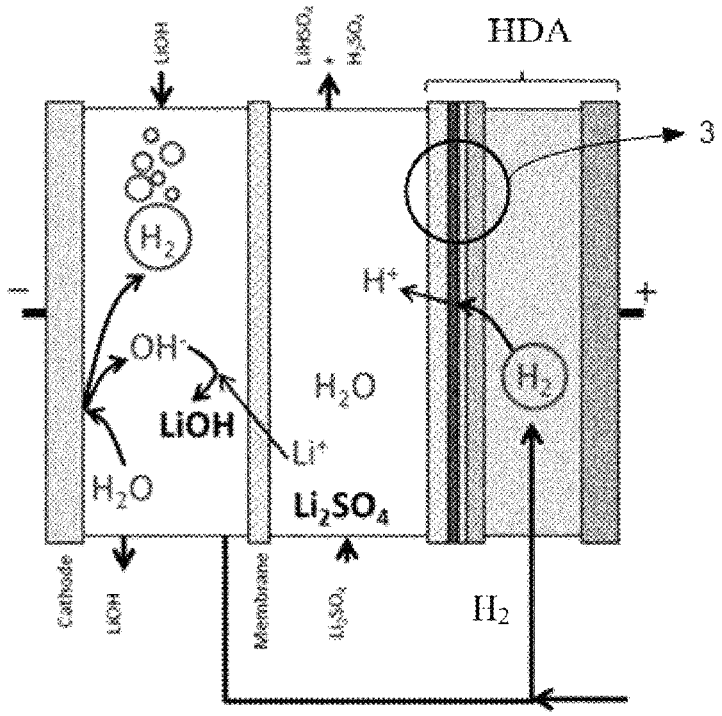
FIG. 2 shows electrolysis of alkali metal salts with hydrogen depolarized anodes such as Hydrogen Depolarized Anode (HDA) for lithium hydroxide (LiOH) production via membrane electrolysis of lithium sulfate ($Li_2SO_4$).

FIG. 1 shows an oxygen evolving anode for lithium hydroxide (LiOH) production via membrane electrolysis of lithium sulfate ($Li_2SO_4$), as shown in WO2013159194, and FIG. 2 shows electrolysis of alkali metal salts with HDAs such as HDAs for lithium hydroxide (LiOH) production via membrane electrolysis of lithium sulfate ($Li_2SO_4$), as shown in U.S. Pat. No. 4,561,945.

Figure 3:
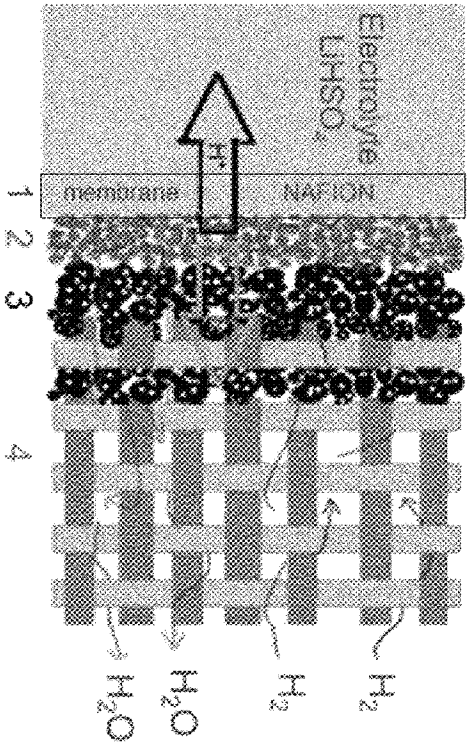
FIG. 3 shows an example of component layers of an HDA for $Li_2SO_4$ electrolysis for LiOH production.

FIG. 3 shows an example of component layers of an HDA that may be used for $Li_2SO_4$ electrolysis for LiOH production. Cation exchange membrane layer 1 is a Nafion™ membrane, followed by the catalyst layer 2, which is a catalyst with Nafion™ as a binder, then layer 3, which is a combination of carbon black and Teflon™, and ultimately, layer 4, which is carbon paper. Layers 3 and 4 form a GDL, layers 2 to 4 form a GDE, and layers 1 to 4 form a membrane electrode assembly (MEA). The HDA comprises the MEA and the current collector (not shown). The MEA is the main component of the HDA technology. The MEA is the area where an electrochemical reaction occurs and separates electrons from hydrogen. As shown in FIGS. 2 and 3, from the back of the HDA, the hydrogen gas circulates through the current collector (not shown) and diffuses through the GDL in order to reach the catalyst layer 2. Cation exchange membrane layer 1 is in contact with the catalyst layer 2, enabling proton diffusion to the anolyte/liquid electrolyte while preventing flooding of it. Typically, Nafion™ membrane 1 (sulfonated polytetrafluoroethylene-based fluoropolymer-copolymer film) is used to create the interface between the liquid electrolyte and hydrogen gas consuming catalyst layer 2. A typical MEA in a HDA is composed of four physical layers. MEAs can be used in fuel cell technology.

Similar or improved performance has now been demonstrated for the technology described herein.

In general, a coated electrode assembly (CEA) is provided. In an embodiment, the CEA comprises a gas diffusion electrode (GDE) and a coating. The GDE comprises a gas diffusion layer (GDL) and a catalyst layer. The catalyst layer is disposed between the coating and the GDL. The catalyst layer comprises a hydrophobic polymer and/or an ionomeric polymer and the coating comprises a hydrophobic polymer and/or an ionomeric polymer. At least one of the catalyst layer and the coating comprises the ionomeric polymer. In a specific embodiment, the catalyst layer is adjacent to the GDL and the coating is adjacent to the catalyst layer. In a further embodiment, the catalyst layer is in contact with the GDL and the coating is in contact with the catalyst layer.

With respect to the embodiments of the CEA, a) the catalyst layer comprises the hydrophobic polymer and the coating comprises the ionomeric polymer; b) the catalyst layer comprises the ionomeric polymer and the coating comprises the hydrophobic polymer; c) the catalyst layer comprises the ionomeric polymer and the coating comprises the ionomeric polymer; d) the catalyst layer comprises the hydrophobic polymer and the ionomeric polymer, and the coating comprises the ionomeric polymer; e) the catalyst layer comprises the hydrophobic polymer and the ionomeric polymer, and the coating comprises the hydrophobic polymer; f) the catalyst layer comprises the hydrophobic polymer and the coating comprises the ionomeric polymer and the hydrophobic polymer; or g) the catalyst layer comprises the ionomeric polymer and the coating comprises the ionomeric polymer and the hydrophobic polymer.

It is understood that the polymer(s) used in the catalyst layer may be the same or different from the polymer(s) used in the coating. For example, the catalyst layer may comprise one ionomeric polymer and the coating may contain the same or a different ionomeric polymer.

Figure 4:
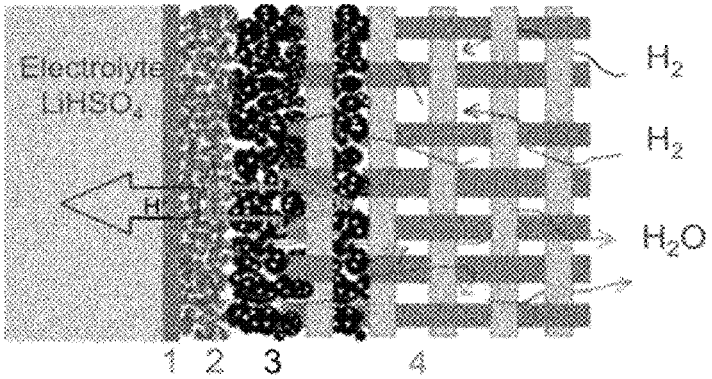
FIG. 4 shows an embodiment of a Coated Electrode Assembly (CEA).

In another embodiment, a hydrogen depolarized gas diffusion anode (HDA) comprises the CEA as described herein. FIG. 4 shows a specific embodiment of a multilayered structure CEA. Layer 1 is the coating (e.g. porous ionomeric polymer), layer 2 is the catalyst layer (e.g. porous ionomeric polymer), layers 3 and 4 are the GDL (e.g. layer 3 is a mixture of carbon black and a hydrophobic polymer (e.g. polytetrafluoroethylene) and layer 4 is carbon paper). Layers 2 to 4 form the GDE. Layers 1 to 4 form the CEA. The CEA and a current collector forms the HDA.

Any suitable hydrophobic polymers may be used in the CEA. The term is understood to encompass hydrophobic polymers and/or copolymers. Examples include hydrophobic fluorine resins such as polychlorotrifluoroethylene resin (PCTFE), polytetrafluoroethylene resin (PTFE), polyvinylidene fluoride resin (PVDF), tetrafluoroethylene-hexa fluoro propylene copolymer (FEP), tetrafluoroethylene-perfluoroalkylvinyl ether copolymer (PFA), and tetrafluoroethylene-ethylene copolymer (ETFE). The term "fluorine resin" refers to a hydrophobic resin containing a fluorine atom in its structure.

Any suitable ionomeric polymers may be used in the CEA. The term is understood to encompass ionomeric polymers and/or copolymers. The ionomeric polymers that may be used herein may include any suitable ionomer having microstructures that allow the passage of $H^+$ ions into the electrolyte while inhibiting the passage of electrolyte solvent molecules (e.g. water molecules) from the electrolyte into the catalyst layer, minimizing flooding of the catalyst layer. The ionomeric polymer may be any suitable polymer substituted with ionizable groups, ionic groups, or both. Any suitable mol % of the polymer comprises ionizable groups, ionic groups, or both. The groups may be any suitable ionizable groups (e.g. sulfonyl halides such as sulfonyl fluoride, sulfonyl chloride, sulfonyl bromides, and phosphonyl halides) and/or ionic groups (e.g. carboxylic acid, sulfonic acid, phosphonic acid, sulfonyl imide, sulfonate, fluoro, and amino groups) that may allow the passage of hydrogen ions while minimizing the passage of hydroxyl ions and other anions. Examples include perfluorinated sulfonic-acid ionomers such as:

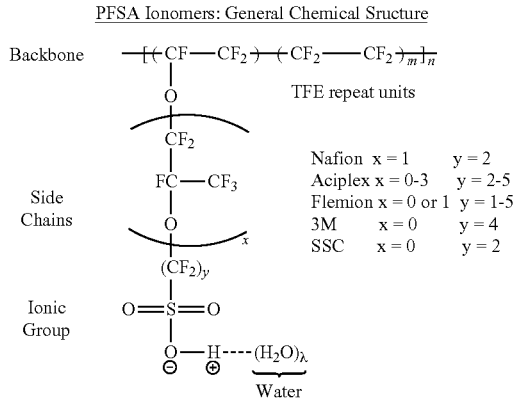

(A. Kusoglu and A. Z. Weber, Chem. Rev. 2017, 117, 987-1104). Common examples of ionomeric polymers include perfluorinated sulfonic acid (PFSA) such as Nafion®, Aquivion®, Flemion® and 3M®, polystyrene sulfonate (PSS), and other partially fluorinated and hydrocarbon non-fluorinated ionomers. As mentioned, the catalyst layer and/or the coating can have a combination of an ionomeric polymer and a hydrophobic polymer, such as Nafion™ and Teflon™.

With respect to the embodiments of the CEA, the coating itself is not a membrane. Specifically, the membrane is a layer (e.g. sheet; stand-alone polymeric layer), which can be applied to a layer (e.g. catalyst layer/GDL) and/or removed from a layer; whereas, a coating is non-detachable.

The catalyst layer and/or the coating may be porous. In certain embodiments, the coating and/or the catalyst layer is mesoporous. In a specific embodiment, the coating and/or the catalyst layer has a pore size range of from about 50 nm to about 200 nm. In other embodiments, the coating and/or the catalyst layer is macroporous. In a specific embodiment, the coating and/or the catalyst layer has a pore size range of from about 2 nm to about 50 nm. Therefore, the coating may be macroporous or mesoporous and the catalyst layer may be macroporous or mesoporous. The coating may be porous and/or non-continuous to minimize flooding of the catalyst layer, for example, under hydrogen gas depolarization conditions. The coating may be a partial coating that permits the passage of $H^+$ ions into the electrolyte while inhibiting the passage of electrolyte solvent molecules (e.g. water molecules) from the electrolyte into the catalyst layer, minimizing flooding of the catalyst layer. Without wishing to be bound by theory, it is believed that less water is converted at the HDA that incorporates the CEA, resulting in a reduced need for polarization and reduced energy-consumption. Without a membrane, it was estimated that the CEA technology saves about 10% on energy consumption and about 30% on anode manufacturing costs.

The coating described herein with respect to the CEA embodiments, may be thin. The coating may have a thickness of less than about 5 μm, less than about 4 μm, less than about 3 μm, less than about 2.8 μm, less than about 2.5 μm, less than about 2 μm, less than about 1.5 μm, less than about 1.0 μm, or less than about 0.5 μm. In more specific embodiments, the coating may have a thickness of from about 100 nm to about 3.0 μm, about 100 nm to about 2 μm, about 100 nm to about 1.0 μm, about 300 nm to about 2.0 μm, or about 300 nm to about 1.0 μm.

In embodiments, the CEA may, however, further comprise a membrane.

The CEA may be resistant to flooding. In embodiments, the CEA has improved performance and stability compared to an MEA (e.g. with a hot-pressed membrane), wherein both the CEA and the MEA have the same GDE. The CEA may have a lower resistance compared to the MEA. The CEA can reach the MEA performance with a current density up to about 4 kA $m^{-2}$ under about 10 $g_{Li}$/L.

The coating of the CEA improves the interface between the catalyst layer and the electrolyte, when used in an electrolytic cell. In embodiments, the GDE and a current collector enable gas consumption, while the coating of the CEA minimizes flooding of the catalyst layer. The electrolytic cell can be any liquid electrolytic cell where gas consumption at an electrode is required while the electrolyte is in direct contact with the electrode. In an MEA, layer 1 may be a cation exchange membrane, allowing the passage of hydrogen ions while rejecting the passage of hydroxyl ions and other anions. Without being bound by theory, when the membrane is replaced with a coating as described herein, the coating permits the passage of $H^+$ ions into the electrolyte while inhibiting the passage of electrolyte solvent molecules (e.g. water molecules) from the electrolyte into the catalyst layer, minimizing flooding of the catalyst layer.

Embodiments of the CEA described herein may be operable at an electrical current density up to about 6 kA/$m^2$, up to about 5 kA/$m^2$, up to about 4 kA/$m^2$, from about 1 kA/$m^2$ to about 6 kA/$m^2$, from about 1 kA/$m^2$ to about 5 kA/$m^2$, from about 1 kA/$m^2$ to about 4 kA/$m^2$, or about 3 kA/$m^2$ to about 4 kA/$m^2$. In a specific embodiment, the CEA is operable at an electrical current density up to about 4 kA/$m^2$ under about 10 $g_{Li}$/L and at a temperature of about 60° C.

Method for Making the CEA

Embodiments of the method of making the CEA or the HDA described herein are provided. In one embodiment, the method comprises forming the coating on the catalyst layer of GDE, wherein the GDE comprises the GDL and the catalyst layer. The catalyst layer comprises a hydrophobic polymer and/or an ionomeric polymer and the coating comprises a hydrophobic polymer and/or an ionomeric polymer. With respect to forming the coating, it may comprise depositing a coating composition on the catalyst layer. The coating composition comprises the hydrophobic polymer and/or the ionomeric polymer. The coating composition may be deposited by spraying, gap coating, slot die coating, roll coating, gravure coating, and any other suitable deposition method. All of the various embodiments described above with respect to the CEA and HDA are incorporated into the embodiments of the methods described herein.

The coating composition may be any suitable polymeric dispersion. The catalyst dispersion comprises a hydrophobic polymer and/or an ionomeric polymer and a suitable solvent. Commercial dispersions are available. Such commercial dispersions are usually diluted with a solvent (e.g. water/alcohol mixture) in order to control the mass of the hydrophobic polymer and/or the ionomeric polymer.

The catalyst layer may be any suitable polymeric catalytic composition, such as a polymeric catalytic dispersion. For example, the dispersion may comprise a catalyst powder, a hydrophobic polymer and/or an ionomeric polymer, and a suitable solvent. Examples include catalyst inks such as a Nafion or Teflon based catalyst dispersions. The catalyst may be any suitable metal-based catalyst such as the platinum group metals (e.g. Pt, Pd) and Pt-M alloys (where M is the non-noble metal alloying component). Commercial dispersions are available. Such commercial dispersions are usually diluted with a solvent (e.g. water/alcohol mixture) in order to control the mass of the hydrophobic polymer and/or the ionomeric polymer.

As mentioned above, depositing the coating composition on the catalyst layer may include, for example, spraying the coating composition. Similarly, the catalyst layer may be deposited on the GDL using a similar spraying procedure. The coating composition may be deposited using a pressurized dispensing valve. The coating composition may be sprayed as a thin coating onto the catalyst layer, for example, the coating may have a thickness of less than about 5 μm, less than about 4 μm, less than about 3 μm, less than about 2.8 μm, less than about 2.5 μm, less than about 2 μm, less than about 1.5 μm, less than about 1.0 μm, or less than about 0.5 μm. In more specific embodiments, the coating may have a thickness of from about 100 nm to about 3.0 μm, about 100 nm to about 2 μm, about 100 nm to about 1.0 μm, about 300 nm to about 2.0 μm, or about 300 nm to about 1.0 μm. With respect to spraying, a pressurized dispensing valve may be used, which may dispense the coating composition from about 4 to about 50 mL/h with about 4 to about 50 paths. This similarly applies to the spraying of the catalyst dispersion for the catalyst layer.

The coating may be formed such that it is porous and/or non-continuous to minimize flooding.

Uses of the CEA

Uses include any suitable electrochemical applications such as any electrochemical devices such as batteries, fuel cells (e.g. Proton Exchange Membrane Fuel Cell (PEMFC) materials configured for HDAs), electrolyzers, that uses HDAs. Any type of electrolysis that requires a proton (H+) production at the anode side in contact with a liquid electrolyte will be covered by this disclosure. Examples include electrochemical systems that require consumption of hydrogen gas to produce acidic electrolyte. Lithium-ion battery grade lithium salts products and $CO_2$ capture and conversion into calcium carbonate, electrolytic recovery of iron from pickling solutions, and could reduce LiOH production cost. The coating of the CEA may be the only barrier separating the catalyst layer from the electrolyte.

The CEA technology described herein, and in particular HDAs that include the CEA, is typically used for liquid-based electrolysis. In particular, it is useful for water-based electrolysis, especially for the conversion of $Li_2SO_4$ to LiOH. For example, producing LiOH directly from $Li_2SO_4$ can be costly and LiOH production cost decrease can be directly proportional to electrochemical cell voltage which can depend partially from the anode operating potential. Higher purity LiOH production is growing since LiOH is becoming an important raw precursor for the cathode production of Li-ion batteries. In embodiments, the HDA electrode may efficiently oxidize hydrogen in a concentrated lithium sulfate environment at a higher current density (e.g. 4 kA $m^{-2}$) while an anode potential can remain below the overpotential, allowing an oxygen evolution reaction.

In embodiments, there is provided an electrolytic cell comprising the CEA as described herein (or the HDA). The cell may be operable at an electrical current density for several minutes or hours up to about 6 kA/$m^2$, up to about 5 kA/$m^2$, up to about 4 kA/$m^2$, from about 1 kA/$m^2$ to about 6 kA/$m^2$, from about 1 kA/$m^2$ to about 5 kA/$m^2$, from about 1 kA/$m^2$ to about 4 kA/$m^2$, or about 3 kA/$m^2$ to about 4 kA/$m^2$. Moreover, the cell may be operable at a temperature from about 20° C. to about 80° C., from about 30° C. to about 80° C., from about 40° C. to about 80° C., from about 50° C. to about 70° C., from about 50° C. to about 65° C., or about 60° C.

In embodiments, there is provided an electrochemical acidification electrolyzer comprising the CEA as described herein (or the HDA). The electrolyzer may be operable at an electrical current density up to about 6 kA/$m^2$, up to about 5 kA/$m^2$, up to about 4 kA/$m^2$, from about 1 kA/$m^2$ to about 6 kA/$m^2$, from about 1 kA/$m^2$ to about 5 kA/$m^2$, from about 1 kA/$m^2$ to about 4 kA/$m^2$, or about 3 kA/$m^2$ to about 4 kA/$m^2$. Moreover, the electrolyzer may be operable at a temperature from about 20° C. to about 80° C., from about 30° C. to about 80° C., from about 40° C. to about 80° C., from about 50° C. to about 70° C., from about 50° C. to about 65° C., or about 60° C.

In an embodiment, an electrolytic system is provided and comprises an anolyte region positioned in an electrochemical cell having an anode. The anolyte region receives an anolyte feed and the anode comprises the CEA described herein (or the HDA that comprises the CEA described herein). The system also has a catholyte region that is positioned in the electrochemical cell, which has a cathode. The catholyte region receives a catholyte feed. There is also an electrical current supplier for applying an electrical current between the anode and the cathode. The cathode may comprise or consist of nickel, palladium, rhodium, indium, cobalt, stainless steel or carbon.

The above disclosure generally describes the present invention. A more complete understanding can be obtained by reference to the following specific Examples. These Examples are described solely for purposes of illustration and are not intended to limit the scope of the invention. Changes in form and substitution of equivalents are contemplated as circumstances may suggest or render expedient. Although specific terms have been employed herein, such terms are intended in a descriptive sense and not for purposes of limitation.

EXAMPLES

Description of the Electrochemical Cells for the Examples

A two compartments cell configuration, namely "acid" HDA cell, was selected. The anode side corresponds to the HDA, where hydrogen gas was oxidized. To complete the reaction, protons generated by the HDA were reduced at the cathode side to form hydrogen gas. Thus, the overall reaction result was null without formation of new product. The cell was used to evaluate the HDA capacity to oxidize $H_2$ and to verify protons ability to migrate from anode to cathode. Cathodes were either carbon flow field plate (25 $cm^2$ cell) or stainless steel plate (50 $cm^2$ cell). Electrolyte circulated from the bottom to the top in a compartment framed with the cathode plate and the HDA (respectively, 3.1 and 6.3 mm thick in 25 $cm^2$ and 50 $cm^2$ cells). The exposed surface area to electrodes were fixed to 25 $cm^2$ and 50 $cm^2$. On the anode side, the HDA was simply set on the current collector, which was either a graphite flow field in 25 $cm^2$ cell or a titanium grid covered by a protective iridium oxide deposit in 50 $cm^2$ cell. The contact of HDA with the current collector was maintained by a gas positive pressure between the cathode and the anode compartments (≈10 inches of water). Dry hydrogen was introduced at the anode side to the back of the HDA, circulating from the top to the bottom. Silicon or Teflon gaskets were intercalated on both sides of middle compartments to inhibit cell leakage and to provide gas separation. All these parts were maintained together by isolated rigid metal external plates using screws.

Example 1: GDE Nafion™+T

About 0.09 mg·cm$^{-2}$ of Nafion™ based dispersion (D2020-EW 1000), about 0.12 mg·cm$^{-2}$ of platinum and about 0.18 mg·cm$^{-2}$ of supported carbon (commercial HiSPEC 4000 from Johnson Matthey) were mixed to form a catalyst ink having about 0.3 wt. % of solids. The catalyst ink was deposited on the GDL (commercial GDL from Sigracet SGL39BC, which is a non-woven carbon paper gas diffusion media with a Microporous Layer (MPL) that has been PTFE treated to about 5% and has a total thickness of about 325 um) using a heated plate 3-axis robot from Fisnar Inc. for automatic dispensing and a pressurized ($N_2$ at about 20 psig) dispensing (about 20 mL/h, about 20 paths) valve forming a GDE. About 0.10 mg·cm$^{-2}$ of Teflon™ based dispersion (Chemours Teflon™ PTFE DISP 30) was sprayed under the same conditions onto the catalyst layer of the GDE to form a coating.

Example 2: GDE Teflon™+N

About 0.03 mg·cm$^{-2}$ of Teflon™ based dispersion (Chemours Teflon™ PTFE DISP 30), about 0.11 mg·cm$^{-2}$ of platinum and about 0.17 mg·cm$^{-2}$ of supported carbon (commercial HiSPEC 4000 from Johnson Matthey) were mixed to form a catalyst ink having about 0.3 wt. % of solids. The catalyst ink was deposited on the GDL (commercial GDL from Sigracet SGL39BC, which is a non-woven carbon paper gas diffusion media with a Microporous Layer (MPL) that has been PTFE treated to about 5% and has a total thickness of about 325 um) using a heated plate 3-axis robot from Fisnar Inc. for automatic dispensing and a pressurized ($N_2$ at about 20 psig) dispensing (about 20 mL/h, about 20 paths) valve forming a GDE. About 0.11 mg·cm$^{-2}$ of Nafion™ based dispersion (D2020-EW 1000) was sprayed under the same conditions onto the catalyst layer of the GDE to form a coating.

Example 3: MEA Nafion™

In this example, the same process for producing a GDE was used but with higher quantities of components to improve performance. A final hot-pressing step was used to apply the Nafion™ membrane.

About 0.37 mg·cm$^{-2}$ of Nafion™ based dispersion (D2020-EW 1000), about 0.49 mg·cm$^{-2}$ of platinum and about 0.79 mg·cm$^{-2}$ of supported carbon (commercial HiSPEC 4000 from Johnson Matthey) were mixed to form a catalyst ink having about 0.3 wt. % of solids. The catalyst ink was deposited on the GDL (commercial GDL from Sigracet SGL39BC, which is a non-woven carbon paper gas diffusion media with a Microporous Layer (MPL) that has been PTFE treated to about 5% and has a total thickness of about 325 um) using a heated plate 3-axis robot from Fisnar Inc. for automatic dispensing and a pressurized ($N_2$ at about 20 psig) dispensing (about 25 mL/h, about 50 paths) valve forming a GDE. About 0.31 mg·cm$^{-2}$ of Nafion™ based dispersion (D2020-EW 1000) was sprayed onto the catalyst layer of the GDE under the same conditions as described in Example 2 to form a coating. About 60 cm$^2$ of NR211 commercial Nafion™ 25 μm membrane (Nafion™ membrane) was then hot pressed over the GDE for about 1.5 min at about 135° C. The Nafion™ based dispersion coated on top of the catalyst layer improved adhesion of the Nafion™ membrane to the GDE.

Example 4: MEA Teflon™

About 0.45 mg·cm$^{-2}$ of Teflon™ based dispersion (Chemours Teflon™ PTFE DISP 30), about 0.14 mg·cm$^{-2}$ of platinum and about 0.21 mg·cm$^{-2}$ of supported carbon (commercial HiSPEC 4000 from Johnson Matthey) were mixed to form a catalyst ink having about 0.3 wt. % of solids. The catalyst ink was deposited on the GDL (commercial GDL from Sigracet SGL39BC, which is a non-woven carbon paper gas diffusion media with a Microporous Layer (MPL) that has been PTFE treated to about 5% and has a total thickness of about 325 um) using a heated plate 3-axis robot from Fisnar Inc. for automatic dispensing and a pressurized ($N_2$ at about 20 psig) dispensing (about 25 mL/h, about 20 paths) valve forming a GDE. About 60 cm$^2$ of NR211 commercial Nafion™ 25 μm membrane (Nafion™ membrane) was then hot pressed over the GDE for about 1.5 min at about 135° C.

Example 4A: MEA Nafion™

About 0.17 mg·cm$^{-2}$ of Nafion™ based dispersion (D2020-EW 1000), about 0.14 mg·cm$^{-2}$ of platinum and about 0.21 mg·cm$^{-2}$ of supported carbon (commercial HiSPEC 4000 from Johnson Matthey) were mixed to form a catalyst ink having about 0.3 wt. % of solids. The catalyst ink was deposited on the GDL (commercial GDL from Sigracet SGL39BC, which is a non-woven carbon paper gas diffusion media with a Microporous Layer (MPL) that has been PTFE treated to about 5% and has a total thickness of about 325 um) using a heated plate 3-axis robot from Fisnar Inc. for automatic dispensing and a pressurized ($N_2$ at about 20 psig) dispensing (about 25 mL/h, about 50 paths) valve forming a GDE. About 60 cm$^2$ of NR211 commercial Nafion™ 25 μm membrane (Nafion™ membrane) was then hot pressed over the GDE for about 1.5 min at about 135° C.

The Example 4A has improved electrochemical performance and stability compared to Examples 3 and 4.

Examples 1 to 4 are summarized in Table 1:

| | | Example 1 GDE | Example 2 GDE | Example 3 MEA | Example 4 MEA |
|---|---|---|---|---|---|
| Membrane | | — | — | NR211 | NR211 |
| Overlayer (mg · cm$^{-2}$) | | Teflon ™ | Nafion ™ | Nafion ™ | — |
| Catalyst Layer (mg · cm$^{-2}$) | Carbon | 0.18 | 0.17 | 0.74 | 0.21 |
| | Platinum | 0.12 | 0.11 | 0.49 | 0.14 |
| | Ionomer or Hydrophobic polymer | Nafion ™ 0.09 | Teflon ™ 0.03 | Nafion ™ 0.37 | Teflon ™ 0.45 |
| GDL | Type | SGL39BC | SGL39BC | SGL39BC | SGL39BC |

Figure 5A:
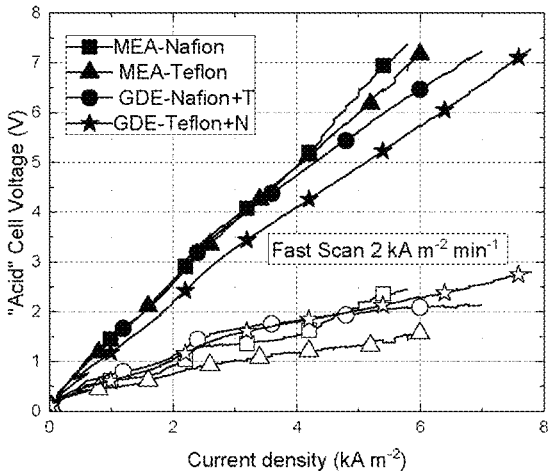
FIGS. 5*a* and 5*b* show short time tests 24 hour) that were performed on 50 $cm^2$ "acid" HDA test cells for Examples 1 to 4.
Figure 5B:
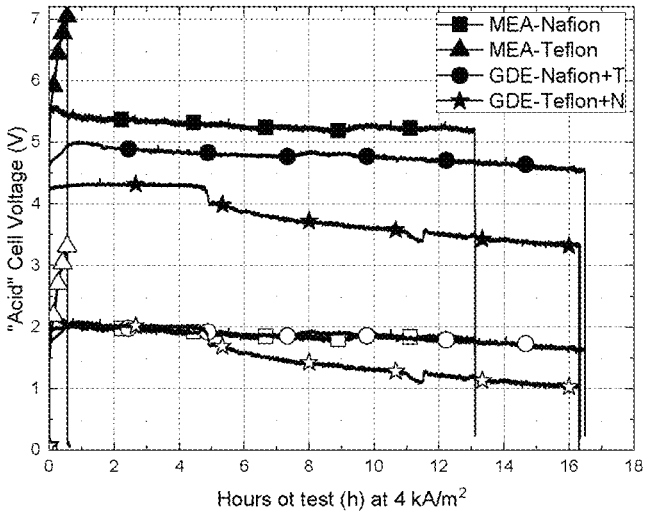
Figure 6:
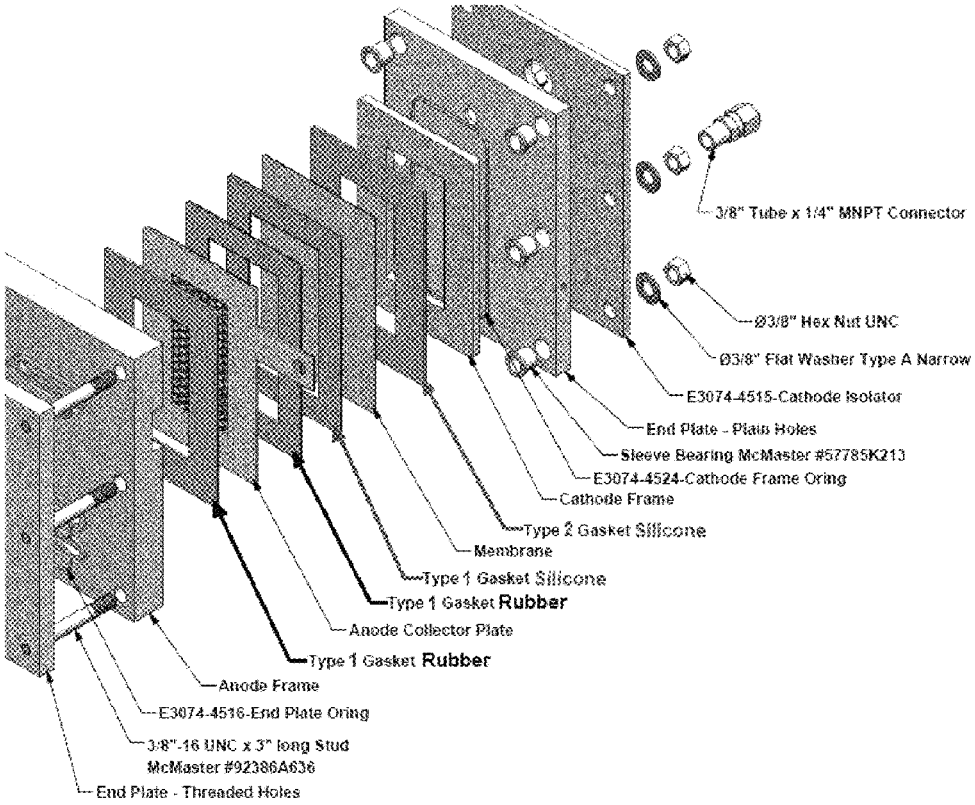
FIG. 6 shows an exploded isometric view of an example of the 50 $cm^2$ "acid" HDA test cells.

Results:

Short time tests about 24 hours) were performed with respect to Examples 1 to 4. Test results are shown in FIGS. 5*a* and 5*b* that were performed on 50 $cm^2$ "acid" HDA test cells for Examples 1 to 4. Cell voltage was compared for the 50 $cm^2$ "acid" HDA test cells for Examples 1 to 4 using linear scan voltage (FIG. 5*a*) and subsequently exposing the cells to about 4 $kA/m^2$ (FIG. 5*b*) under about 10 $g_{Li}/L$, at a temperature of about 60° C. and a flow rate of about 0.75 L/min. Lines indicated with open symbols in FIG. 5*a* are iR-free corrected cell voltage. The "acid" HDA test cells are shown in an exploded isometric view in FIG. 6 with about a 6.5 mm gap between the cathode and anode (including gaskets). The GDL material (SGL39BC) was compressed between Type 1 and 2 silicone-gaskets, each with a thickness of about 397 μm, and was tested for about 24 hours, at a temperature of about 60° C. with about 20% lithium converted 0.8M bisulfate solution.

The information provided in Table 2 characterizes the HDA performance for Examples 1 to 4.

TABLE 2

| | | Example 1 GDE | Example 2 GDE | Example 3 MEA | Example 4 MEA |
|---|---|---|---|---|---|
| High Frequency Resistance (HFR) cell resistance after test (mΩ) | | 146 | 115 | 170 | 190 |
| Specifications of liquid collected at the anode side | Leak rate (mL/h) | 7.6 | 7.8 | 4.2 | 4.0 |
| | pH | 1.25 | 1.10 | 2.38 | 1.78 |
| | Conductivity ($mS \cdot cm^{-1}$) | 71.7 | 100.9 | 5.1 | 11.8 |

The HFR cell resistance was measured without applying current and was obtained by impedance spectroscopy (about ±10 mV perturbation at about 0 amps between about 1 MHz to about 100 Hz). Cell resistance is provided for the imaginary component of the impedance being zero (Im(Z)=0). The results indicated that there was a decrease in resistance for the HDA's in Examples 1 and 2 (i.e. no Nafion™ membrane). Testing with about 10 $g_{Li+}/L$ electrolyte, Examples 3 and 4, which include the Nafion™ membrane, appeared to add about 0.25 mΩ $m^2$ when hot-pressed to a GDE.

With respect to the specifications of the liquid collected at the anode side (e.g. the gas-out stream side), the liquid was analyzed. The results indicated liquid permeation through the GDE. For the GDE without the Nafion™ membrane (Examples 1 and 2), exhaust liquid was close to the original electrolyte specifications. In contrast, the GDE with the Nafion™ membrane for the MEA's configurations (Examples 3 and 4) appeared to have a decrease Li+ permeation, which was illustrated by conductivity reduction and pH increase.

Figure 7A:
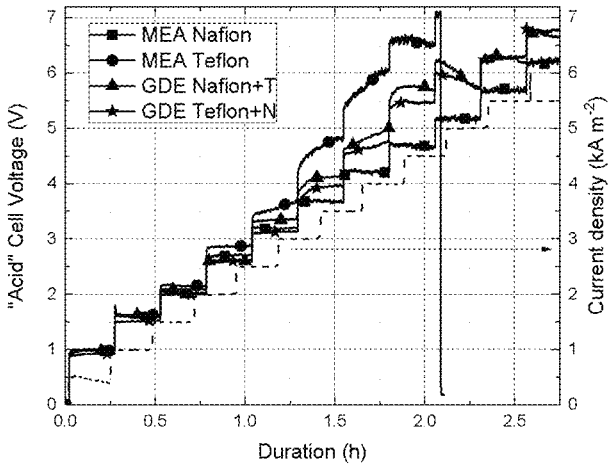
FIGS. 7*a* and 7*b* show results of a cell voltage comparison of the 50 $cm^2$ "acid" HDA test cells that were tested using 0.5 h current step increases (FIG. 7*a*) and 0.5 h current step decreases (FIG. 7*b*).
Figure 7B:
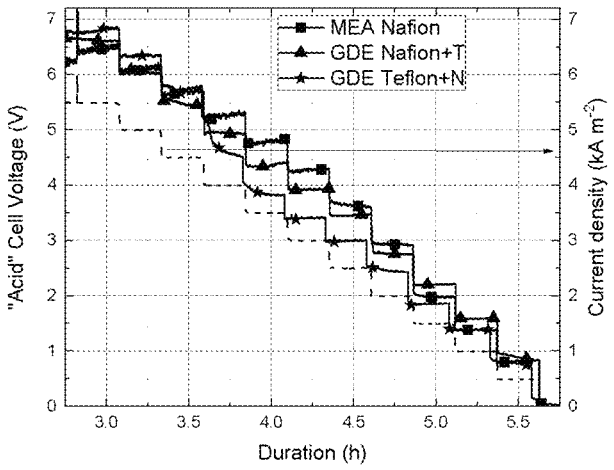

Test results are shown in FIGS. 7*a* and 7*b* and show the comparison of the cell voltages of the 50 $cm^2$ "acid" HDA test cells using 0.5 h current step increases from 0 to 6 kA $m^{-2}$ (FIG. 7*a*) and 0.5 h current step decreases from 6 to 0 kA $m^{-2}$ (FIG. 7*b*) under about 10 gLi/L, at a temperature of about 60° C. and a flow rate of about 0.75 L/min for about 5.5 hours. With respect to FIGS. 7*a* and 7*b*, a square wave current (dashed line) is forced through polarizable cell electrodes and the voltage response of the test cell over time is measured. Tests in FIGS. 7*a* and 7*b* were performed before tests in FIGS. 5*a* and 5*b*.

Based on the Examples tested, Examples 1 and 2 (without the Nafion™ membrane) appear to be better than Examples 3 and 4 (with the Nafion™ membrane). Examples 1 and 2 have improved performance and stability. At about 10 $g_{Li}/L$, the coated GDE configurations of Examples 1 and 2 were capable of reaching the MEA performance of Examples 3 and 4 when the current density was at most about 4 $kA \cdot m^{-2}$.

Examples 5 to 8

Examples 5 to 7 are the same as Example 1 and Example 8 is the same as Example 2 except for the amounts listed in Table 3:

TABLE 3

| GDE | Cell Voltage (V) | Stability Overnight* | Catalyst Layer | Coat |
|---|---|---|---|---|
| Example 5 (GDE 5) | 3.18 | No | 16 $\mu g \cdot cm^{-2}$ Teflon ™ | 81 $\mu g \cdot cm^{-2}$ Nafion ™ |
| Example 6 (GDE 6) | 2.51 | Yes (very) | 33 $\mu g \cdot cm^{-2}$ Teflon ™ | 53 $\mu g \cdot cm^{-2}$ Nafion ™ |

TABLE 3-continued

| GDE | Cell Voltage (V) | Stability Overnight* | Catalyst Layer | Coat |
|---|---|---|---|---|
| Example 7 (GDE 8) | 2.99 | Yes (some increase) | 53 $\mu g \cdot cm^{-2}$ Teflon ™ | 81 $\mu g \cdot cm^{-2}$ Nafion ™ |
| Example 8 (GDE 10) | 2.68 | Yes (very) | 81 $\mu g \cdot cm^{-2}$ Nafion ™ | 90 $\mu g \cdot cm^{-2}$ Teflon ™ |

*Stability is defined here as the capacity of the GDE to remain at its specific voltage over time while a fixed DC current is imposed to the cell.

To further enhance efficacy of HDA without membrane while reducing their overall resistances, thinner GDLs were used for GDE 5, 6, 8 and 10 (SGL29BC) at about 235 μm thickness, compared to Examples 1 to 4 (SGL39BC) at about 325 μm thickness.

Figure 8:
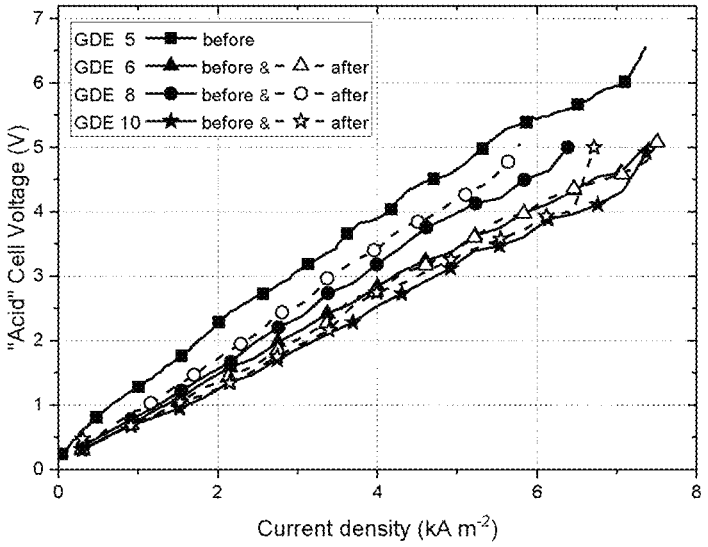
FIG. 8 shows results of a cell voltage comparison of the 50 $cm^2$ "acid" HDA test cells for Examples 5 to 8 tested by current steps (10 min increments) method before and after an overnight test at about 4 kA/$m^2$ under about 20-25 $g_{Li}$ $L^{-1}$, at a temperature of about 60° C.

Test results are shown in FIG. 8 and show the comparison of the cell voltages of the 25 $cm^2$ "acid" HDA test cells (based on design of 50 $cm^2$ "acid" HDA test cell) for Examples 5 to 8 tested by current steps (10 min increments) method before and after an overnight test at about 4 $kA/m^2$ under about 20-25 $g_{Li}/L$ and at a temperature of about 60° C. The catalyst layer containing the least amount of Teflon™ (Example 5 with GDE 5) was not able to maintain a substantially stable voltage at about 4 $kA/m^2$ (cell voltage above 5V).

Based on the examples provided above, the ionomer and/or hydrophobic polymer (e.g. Nafion™ or Teflon™) can be used in the catalyst layer and/or as a coating on the catalyst layer of the GDE. Otherwise, flooding of the GDE appeared to occur and anode voltage exceeded the oxygen evolution potential (such as with example 5). The GDE configuration having the ionomer in the catalyst layer with the hydrophobic polymer coating (Examples 1 and 8), provided good results. At about 10 $g_{Li}$ $L^{-1}$, the GDE examples 1, 2 and 5 to 8 reached MEA performances when current density was at most about 4 kA $m^{-2}$. In Example 3, since a membrane was included, an ionomer in the catalyst layer ensured proton conductivity (i.e. very low permeation of electrolyte through the membrane).

Example 9: HDA Development Full Height Acrylic Cell Electrochemical Testing for GDE Twelve GDEs were produced in accordance with Example 1, by using a heated plate 3-axis robot from Fisnar Inc. for automatic dispensing (at about 100° C.) a feed by first spraying Pt/C-Nafion™ catalyst ink on the GDL to form a catalyst layer and secondly by spraying the Teflon™ dispersion on the catalyst layer (FIG. 9). The GDL was SGL39BC (210 mm×160 mm); catalyst layer (152 mm×100 mm) was supported carbon HiSPEC 4000 (40 wt. % Pt) 0.14±0.01 $mg_{Pt}$ $cm^{-2}$, Nafion™ DE2020 ionomer 100±10 $\mu g_{Nafion}$ $cm^{-2}$; and the hydrophobic coat (157 mm×105 mm) was formed from the Teflon™ based dispersion (with triton X-100) 30±3 $\mu g_{Teflon}$ $cm^{-2}$.

Full Height Acrylic Cell Design and electrochemical tests were performed by NORAM Engineering. Custom-designed MEAs from American Fuel Cell LLC were used, with the same specification as the twelve GDEs above for the catalyst layer, while a 15 μm PTFE reinforced membrane was used. The MEAs and GDEs were installed and tested by NORAM Engineering in a full height acrylic cell.

Figure 11:
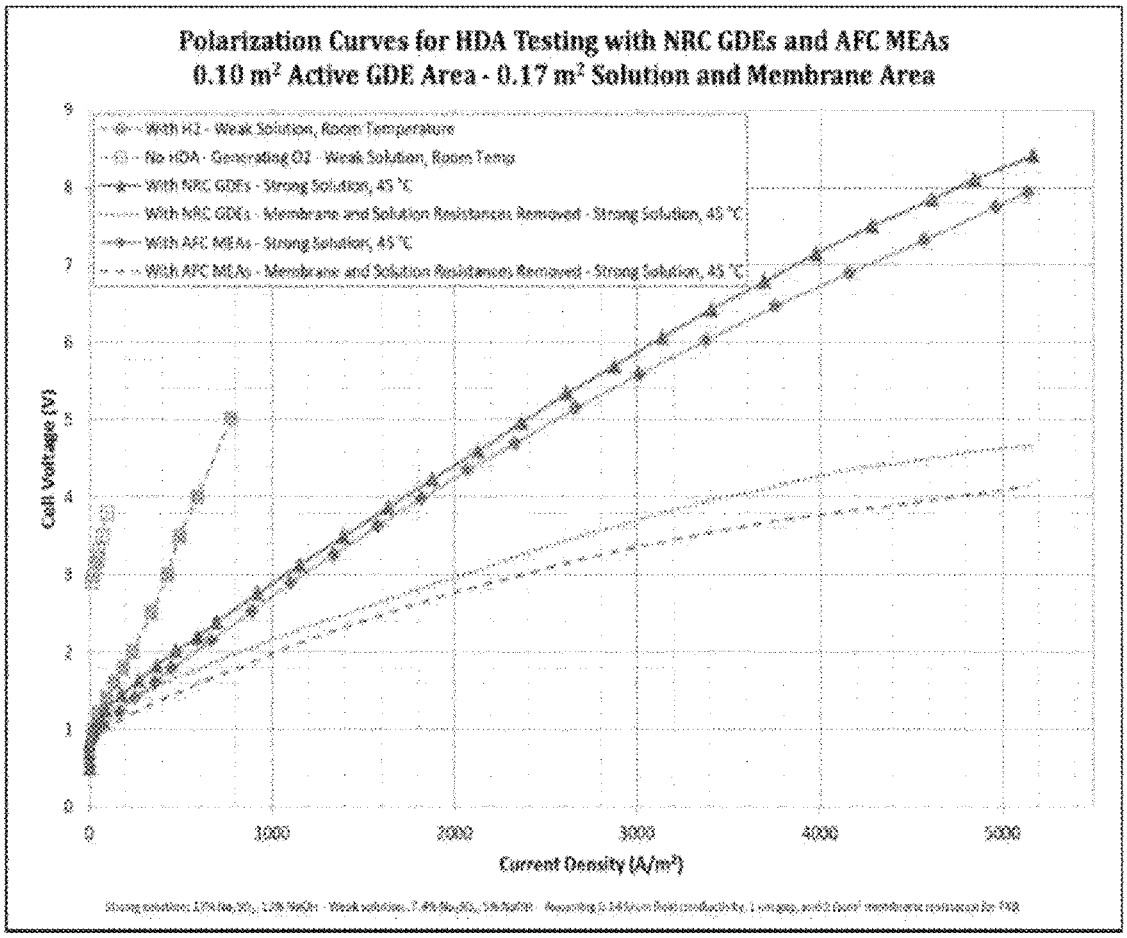
FIG. 11 shows examples of the HDA pilot-test cells for producing LiOH from $Li_2SO_4$.

FIGS. 10*a* to 10*c* show a) single GDE electrode panel with Kapton™-taped perimeter (hydrophobic coating showing); b) "window frame" assembly of embodiments of GDEs aligned before installation; c) center compartment on top of GDE assembly (tests carried out at NORAM R&D labs). FIG. 11 shows examples of the HDA pilot-test cells for producing LiOH from $Li_2SO_4$. Contrary to "Acid" HDA cell tests, the $H_2$ feeding anode side in the full height acrylic cell is humidified. The GDEs showed similar initial performances compared to the MEAs in a full Height Electrochemical Cell simulating LiOH production.

The above disclosure generally describes the present invention. Although specific terms have been employed herein, such terms are intended in a descriptive sense and not for purposes of limitation.

Patent applications, patents, and publications are cited herein to assist in understanding the embodiments described. All such references cited herein are incorporated herein by reference in their entirety and for all purposes to the same extent as if each individual publication or patent or patent application was specifically and individually indicated to be incorporated by reference in its entirety for all purposes. To the extent publications and patents or patent applications incorporated by reference contradict the disclosure contained in the specification, the specification is intended to supersede and/or take precedence over any such contradictory material.

Although specific embodiments of the invention have been described herein in detail, it will be understood by those skilled in the art that variations may be made thereto without departing from the spirit of the invention or the scope of the appended claims.

It will be understood that certain of the above-described structures, functions, and operations of the above-described embodiments are not necessary to practice the present invention and are included in the description simply for completeness of an exemplary embodiment or embodiments. In addition, it will be understood that specific structures, functions, and operations set forth in the above-described referenced patents and publications can be practiced in conjunction with the present invention, but they are not essential to its practice. It is therefore to be understood that the invention may be practiced otherwise than as specifically described without actually departing from the spirit and scope of the present invention as defined by the appended claims.

We claim:

1. A coated electrode assembly (CEA) comprising:

i) a gas diffusion electrode (GDE); and ii) a non-detachable coating, wherein the GDE comprises a gas diffusion layer (GDL) and a catalyst layer, the catalyst layer being disposed between the coating and the GDL, wherein the catalyst layer comprises a hydrophobic polymer and/or an ionomeric polymer and the coating comprises a hydrophobic polymer and/or an ionomeric polymer, and wherein at least one of the catalyst layer and the coating comprises the ionomeric polymer.

2. The CEA of claim 1, wherein one or more of the following:

a) the catalyst layer is adjacent to the GDL and the coating is adjacent to the catalyst layer; and b) the catalyst layer is in contact with the GDL and the coating is in contact with the catalyst layer.

3. The CEA of claim 1, wherein the catalyst layer comprises:

a) the hydrophobic polymer and the coating comprises the ionomeric polymer;

b) the ionomeric polymer and the coating comprises the hydrophobic polymer;

c) the ionomeric polymer and the coating comprises the ionomeric polymer;

d) the hydrophobic polymer and the ionomeric polymer, and the coating comprises the ionomeric polymer;

e) the hydrophobic polymer and the ionomeric polymer, and the coating comprises the hydrophobic polymer;

f) the hydrophobic polymer and the coating comprises the ionomeric polymer and the hydrophobic polymer; or g) the ionomeric polymer and the coating comprises the ionomeric polymer and the hydrophobic polymer.

4. The CEA of claim 1, wherein the coating and/or the catalyst layer is porous and/or non-continuous and, optionally:

i) the coating and/or the catalyst layer is mesoporous or the coating and/or the catalyst layer is mesoporous and has a pore size range of from about 2 nm to about 50 nm; or ii) the coating and/or the catalyst layer is macroporous, optionally, the coating and/or the catalyst layer has a pore size range of from about 50 nm to about 200 nm.

5. The CEA of claim 1, wherein the coating has a thickness of about 100 nm to about 2 μm; or a thickness of about 100 nm to about 1 um.

6. The CEA of claim 1, wherein the coating minimizes flooding of the catalyst layer.

7. The CEA of claim 1, wherein the ionomeric polymer comprises a perfluorinated sulfonic acid (PFSA) ionomer, optionally, the PFSA ionomer is selected from Nafion®, Aquivion®, Flemion® and 3M®, polystyrene sulfonate (PSS), or a combination thereof.

8. The CEA of claim 1, wherein the hydrophobic polymer comprises hydrophobic fluorine resins, optionally, the hydrophobic polymer is selected from polychlorotrifluoroethylene resin (PCTFE), polytetrafluoroethylene resin (PTFE), polyvinylidene fluoride resin (PVDF), tetrafluoroethylene-hexa fluoro propylene copolymer (FEP), tetrafluoroethylene-perfluoroalkylvinyl ether copolymer (PFA), tetrafluoroethylene-ethylene copolymer (ETFE), or a combination thereof, or the hydrophobic polymer comprises polytetrafluoroethylene (PTFE).

9. The CEA of claim 1, wherein the CEA excludes a membrane and/or is resistant to flooding.

10. The CEA of claim 1, wherein the catalyst layer is a metal catalyst-based layer, the metal for electro-oxidizing $H_2$ to $H^+$.

11. The CEA of claim 1, wherein the CEA has improved or similar performance and stability compared to a membrane electrode assembly (MEA), each assembly having the same GDE and/or the CEA has a lower resistance compared to a membrane electrode assembly (MEA), each assembly having the same gas diffusion electrode (GDE), optionally:

the CEA reached the MEA performance with a current density up to about 4 kA $m^{-2}$ under about 10 $g_{Li}$/L, and/or the MEA has a hot-pressed membrane.

12. The CEA of claim 1, wherein the CEA is operable at an electrical current density up to about 6 kA/$m^2$, up to about 5 kA/$m^2$, up to about 4 kA/$m^2$, from about 1 kA/$m^2$ to about 6 kA/$m^2$, from about 1 kA/$m^2$ to about 5 kA/$m^2$, from about 1 kA/$m^2$ to about 4 kA/$m^2$, or about 3 kA/$m^2$ to about 4 kA/$m^2$, optionally, the CEA is operable at an electrical current density up to about 4 kA/$m^2$ under about 10 gui/L and at a temperature of about 60° C.

13. A hydrogen depolarized gas diffusion anode (HDA) comprises the CEA as defined in claim 1.

14. An electrolytic cell comprising the CEA as defined in claim 1, optionally, the cell is operable at an electrical current density up to about 6 kA/$m^2$, up to about 5 kA/$m^2$, up to about 4 kA/$m^2$, from about 1 kA/$m^2$ to about 6 kA/$m^2$, from about 1 kA/$m^2$ to about 5 kA/$m^2$, from about 1 kA/$m^2$ to about 4 kA/$m^2$, or about 3 kA/$m^2$ to about 4 kA/$m^2$; and/or the cell is operable at a temperature from about 20° C. to about 80° C., from about 30° C. to about 80° C., from about 40° C. to about 80° C., from about 50° C. to about 70° C., from about 50° C. to about 65° C., or about 60° C.

15. An electrolytic cell comprising the HDA as defined in claim 13, optionally, the cell is operable at an electrical current density up to about 6 kA/$m^2$, up to about 5 kA/$m^2$, up to about 4 kA/$m^2$, from about 1 kA/$m^2$ to about 6 kA/$m^2$, from about 1 kA/$m^2$ to about 5 kA/$m^2$, from about 1 kA/$m^2$ to about 4 kA/$m^2$, or about 3 kA/$m^2$ to about 4 kA/$m^2$; and/or the cell is operable at a temperature from about 20° C. to about 80° C., from about 30° C. to about 80° C., from about 40° C. to about 80° C., from about 50° C. to about 70° C., from about 50° C. to about 65° C., or about 60° C.

16. A fuel cell comprising the CEA of claim 1.

17. A fuel cell comprising the HDA of claim 13.

18. An electrolytic system comprising:

an anolyte region positioned in an electrochemical cell having an anode, wherein the anolyte region receives an anolyte feed and the anode comprises the CEA as defined in claim 1;

a catholyte region positioned in the electrochemical cell having a cathode, wherein the catholyte region receives a catholyte feed; and an electrical current supplier for applying an electrical current between the anode and the cathode.

19. A method for making the CEA of claim 1, the method comprising:

forming the coating on the catalyst layer of the GDE; optionally, forming comprises depositing a coating composition on the catalyst layer, the coating composition comprising the hydrophobic polymer and/or the ionomeric polymer, optionally, the depositing comprises spraying, gap coating, slot die coating, roll coating, or gravure coating the coating composition, optionally, spraying comprises spraying the coating composition with a pressurized dispensing valve.

20. A coated electrode assembly (CEA) made using the method of claim 19, wherein the CEA comprises:

i) a gas diffusion electrode (GDE); and ii) a non-detachable coating, wherein the GDE comprises a gas diffusion layer (GDL) and a catalyst layer, the catalyst layer being disposed between the coating and the GDL, wherein the catalyst layer comprises a hydrophobic polymer and/or an ionomeric polymer and the coating comprises a hydrophobic polymer and/or an ionomeric polymer, and wherein at least one of the catalyst layer and the coating comprises the ionomeric polymer.

* * * * *